US009631788B2

(12) United States Patent
Lin

(10) Patent No.: US 9,631,788 B2
(45) Date of Patent: Apr. 25, 2017

(54) LIGHT SHIELDING STRUCTURE FOR LED LAMP

(71) Applicant: MODERN HOME LIGHTING INC., Dongguan, Guangdong Province (CN)

(72) Inventor: Shih-Ming Lin, Dongguan (CN)

(73) Assignee: Modern Home Lighting Inc., Dongguan, Guangdong Province (CN)

( * ) Notice: Subject to any disclaimer, the term of this patent is extended or adjusted under 35 U.S.C. 154(b) by 94 days.

(21) Appl. No.: 14/697,672

(22) Filed: Apr. 28, 2015

(65) Prior Publication Data

US 2016/0320014 A1 Nov. 3, 2016

(51) Int. Cl.

| | |
|---|---|
| ***F21V 3/02*** | (2006.01) |
| ***F21V 3/04*** | (2006.01) |
| ***F21V 13/02*** | (2006.01) |
| ***F21V 15/00*** | (2015.01) |
| *F21S 6/00* | (2006.01) |
| *F21Y 115/10* | (2016.01) |

(52) U.S. Cl.

CPC ..... *F21V 3/02* (2013.01); *F21V 3/0409* (2013.01); *F21V 13/02* (2013.01); *F21V 15/00* (2013.01); *F21S 6/003* (2013.01); *F21Y 2115/10* (2016.08)

(58) Field of Classification Search

CPC ... F21V 3/02; F21V 1/02; F21V 13/02; F21V 13/0409; F21V 15/00

See application file for complete search history.

(56) References Cited

U.S. PATENT DOCUMENTS

2009/0122552 A1* 5/2009 Liu ..... F21V 29/77 362/294

2012/0169203 A1* 7/2012 Tsai ..... F21V 23/009 313/116

* cited by examiner

*Primary Examiner* — David V Bruce

(74) *Attorney, Agent, or Firm* — Alan D. Kamrath; Kamrath IP Lawfirm, P.A.

(57) ABSTRACT

A light shielding structure for an LED lamp contains: a lamp holder, a light cover, and a light shade. The lamp holder includes an LED light disc mounted on a top surface thereof and a support frame fixed proximate to an outer peripheral side of the top surface of the lamp holder. The light cover includes a connecting rack disposed in a top end thereof and connected with the support frame. The light shade is made of translucent material and is fitted with the LED light disc. Thereby, lights emit gently and evenly form the LED light disc via the light shade, and a light shadow of the connecting rack does not project upwardly. Preferably, the light shielding structure prevents insects or objects from dropping into the LED lamp.

2 Claims, 4 Drawing Sheets

LIGHT SHIELDING STRUCTURE FOR LED LAMP

FIELD OF THE INVENTION

The present invention relates to a light shielding structure for an LED lamp which emits lights form the LED light disc gently and evenly via a light shade.

BACKGROUND OF THE INVENTION

As shown in FIG. 1, a conventional LED lamp contains an LED light bulb A having a lower glass surface A1 and a lower glass surface A2 which are formed together to illumine lights directly; and a light cover B having a connecting rack B1 disposed in a top end of the light cover B. However, the lights directly illuminate outward and upward from the LED light bulb A to cause a light shadow of the connecting rack and an uneven brightness.

The present invention has arisen to mitigate and/or obviate the afore-described disadvantages.

SUMMARY OF THE INVENTION

The primary objective of the present invention is to provide a light shielding structure for an LED lamp which emits lights form the LED light disc gently and evenly via a light shade, and a light shadow of a connecting rack does not project upwardly.

Further objective of the present invention is to provide a light shielding structure for an LED lamp which prevents insects or objects from dropping into the LED lamp.

Another objective of the present invention is to provide a light shielding structure for an LED lamp which illuminates the lights at a wide angle.

DETAILED DESCRIPTION OF THE PREFERRED EMBODIMENTS

Figure 1:
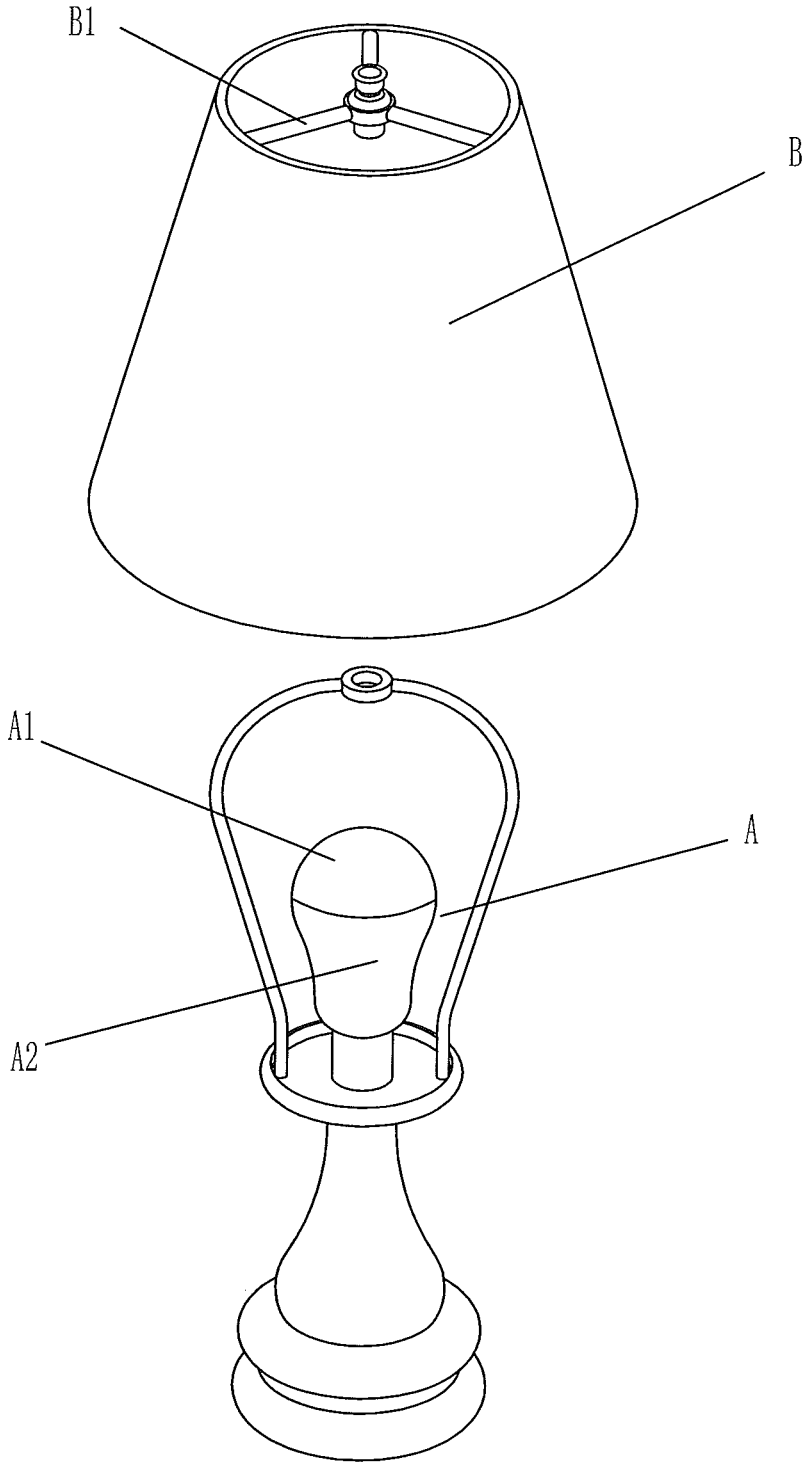
FIG. 1 PRIOR ART
FIG. 1 is a perspective view of a conventional LED lamp.
Figure 2:
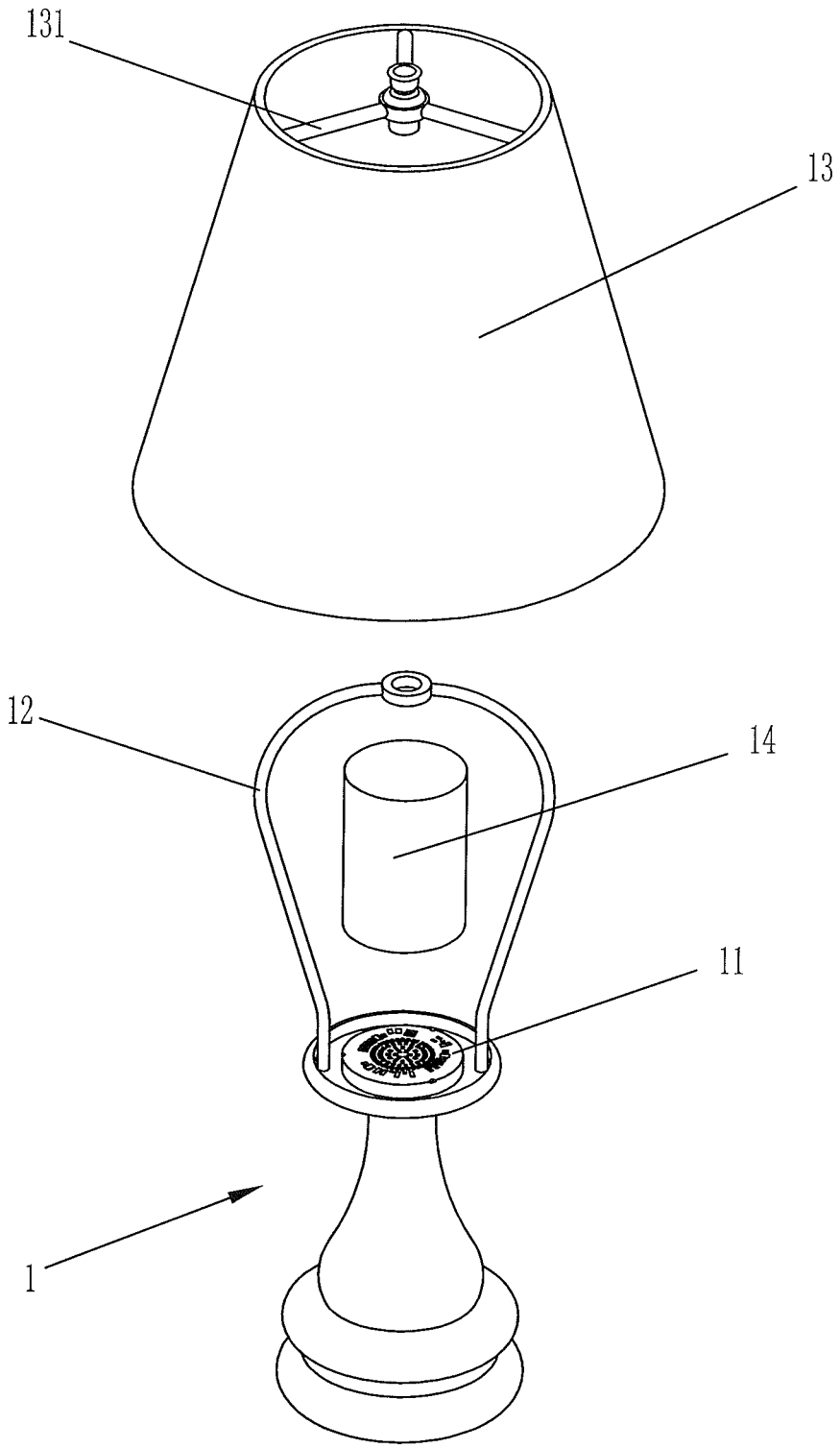
FIG. 2 is a perspective view showing the exploded components of a light shielding structure for an LED lamp according to a first embodiment of the present invention.
Figure 3:
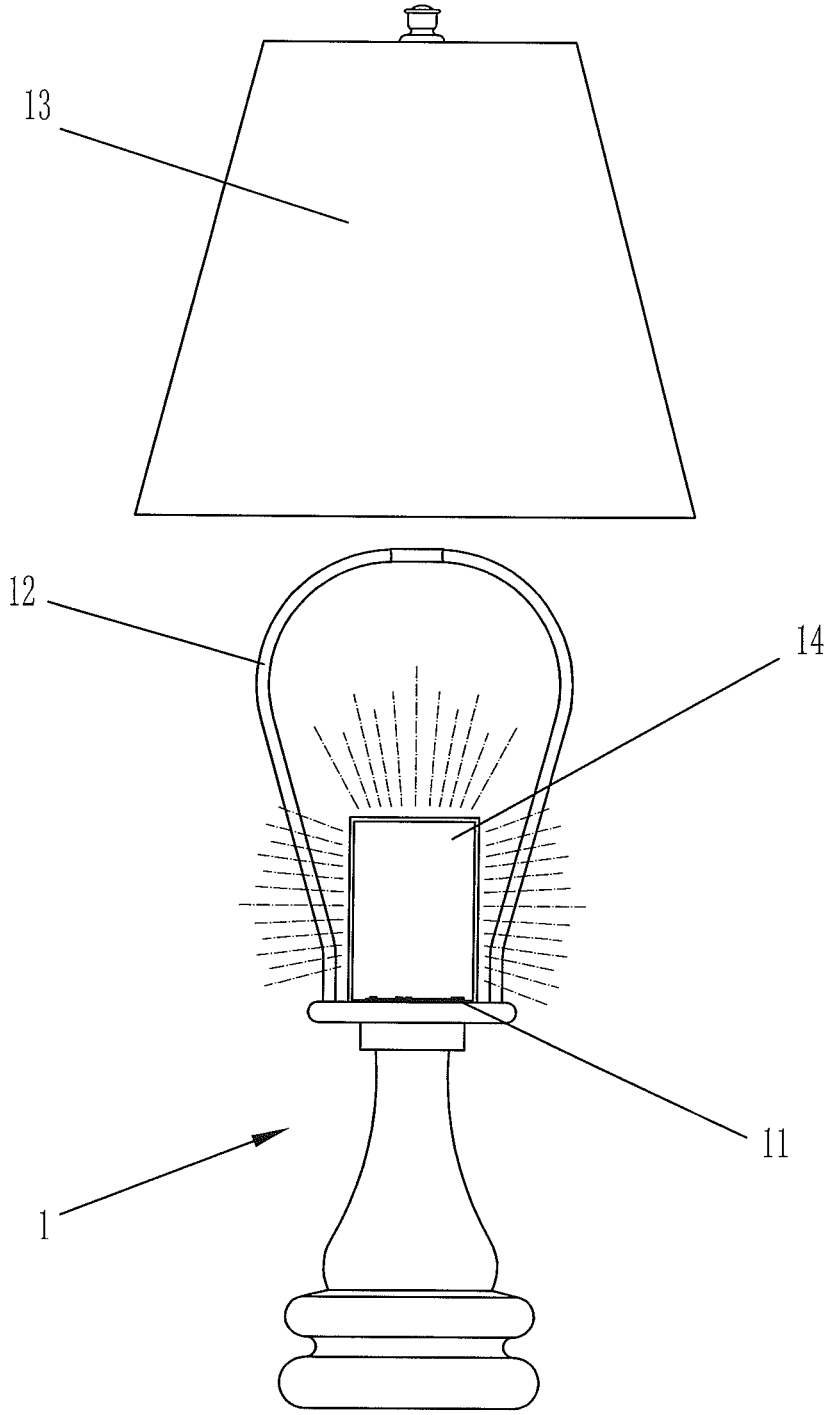
FIG. 3 is a side plane view showing the exploded components of the light shielding structure for the LED lamp according to the first embodiment of the present invention.

With reference to FIGS. 2 and 3, a light shielding structure for an LED lamp according to a first embodiment of the present invention comprises:

a lamp holder 1 including an LED light disc 11 mounted on a top surface thereof and a support frame 12 fixed proximate to an outer peripheral side of the top surface of the lamp holder 1;

a light cover 13 including a connecting rack 131 disposed in a top end thereof and connected with the support frame 12; and a light shade 14 made of translucent material and fitted with the LED light disc 11.

In assembly, the LED light disc 11 of the lamp holder 1 is fitted with the light shade 14, and then the light cover 13 is connected with the support frame 12 of the lamp holder 1, such that lights emit gently and evenly form the LED light disc 11 via the light shade 14, and a light shadow of the connecting rack 131 does not project upwardly. Preferably, the light shielding structure of the present invention prevents insects or objects from dropping into the LED lamp.

Figure 4:
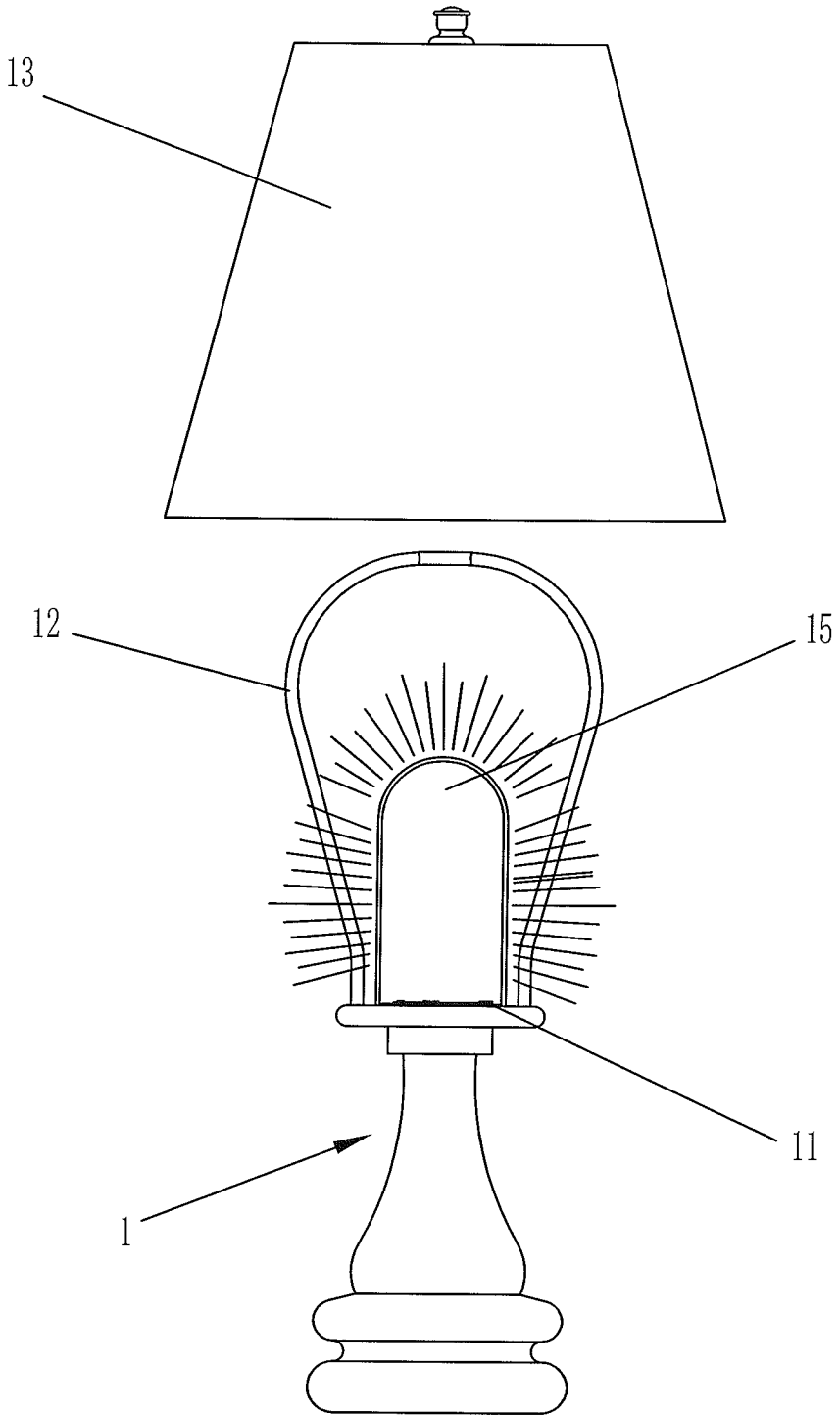
FIG. 4 is a side plane view showing the exploded components of a light shielding structure for an LED lamp according to a second embodiment of the present invention.

Referring to FIG. 4, a difference of a light shielding structure for an LED lamp of a second embodiment from that of the first embodiment comprises: a light shade 15 having an arcuate face 142 formed on a top end thereof to illuminate lights at a wide angle.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A light shielding structure for an LED lamp comprising:

a lamp holder including an LED light disc mounted on a top surface thereof and a support frame fixed proximate to an outer peripheral side of the top surface of the lamp holder;

a light cover including a connecting rack disposed in a top end thereof and connected with the support frame; and a light shade made of translucent material and fitted with the LED light disc;

wherein the light shade has a flat face formed on a top end thereof.

2. A light shielding structure for an LED lamp comprising:

a lamp holder including an LED light disc mounted on a top surface thereof and a support frame fixed proximate to an outer peripheral side of the top surface of the lamp holder;

a light cover including a connecting rack disposed in a top end thereof and connected with the support frame; and a light shade made of translucent material and fitted with the LED light disc;

wherein the light shade has an arcuate face formed on a top end thereof.

* * * * *